United States Patent [19]

Shear

[11] 4,397,175

[45] Aug. 9, 1983

[54] APPARATUS FOR CONTROLLING THE MOVEMENT OF A RECIPROCATORY HYDRAULICALLY DRIVEN ELEMENT

[75] Inventor: William F. Shear, Goodlettsville, Tenn.

[73] Assignee: The Gleason Works, Rochester, N.Y.

[21] Appl. No.: 257,100

[22] Filed: Apr. 24, 1981

[51] Int. Cl.[3] ..... B21J 9/12

[52] U.S. Cl. ..... 72/453.02; 72/453.18

[58] Field of Search ..... 72/453.02, 453.01, 453.05, 72/453.07, 453.18, 343, 354, 60; 100/269 R; 91/394, 441

[56] References Cited

U.S. PATENT DOCUMENTS

| | | | |
|---|---|---|---|
| 2,220,798 | 11/1940 | Dinzl | 100/269 R |
| 2,937,606 | 5/1960 | Paulton | 100/269 R |
| 3,290,919 | 12/1966 | Malinak | 72/453.05 |
| 3,792,644 | 2/1974 | Ferguson | 91/394 |
| 4,197,757 | 4/1980 | Hackett | 72/264 |
| 4,341,106 | 7/1982 | Hackett | 72/453.07 |

*Primary Examiner*—Gene Crosby

*Attorney, Agent, or Firm*—Luedeka & Neely

[57] ABSTRACT

A system is provided for two speed movement of a hydraulically driven element. The system includes a housing for a primary piston having a longitudinal bore open at one end. A secondary piston is received within the open bore end to define a secondary expandable reservoir within the primary piston. The primary piston includes a secondary working face disposed within the secondary expandable reservoir and a primary working face disposed in a primary expandable reservoir. High pressure hydraulic fluid is introduced into the secondary expandable reservoir for high speed movement. When the primary piston reaches a predetermined location, high pressure hydraulic fluid is introduced into both reservoirs for low speed movement.

8 Claims, 3 Drawing Figures

APPARATUS FOR CONTROLLING THE MOVEMENT OF A RECIPROCATORY HYDRAULICALLY DRIVEN ELEMENT

The present invention relates to metal forming machines and particularly to hydraulic cylinders for the cold forming of metals.

In the cold forming of metals a metal billet is deposited in a die cavity. The billet is then subjected to the compressive force of one or more members operating under the influence of hydraulic pressure. In the apparatus disclosed in U.S. Pat. No. 4,197,757, the billet is subjected to three separate compressive forces from a ram, an anvil and a power pad, each of which is driven by a hydraulic cylinder. Upon completion of the formed article, the ram, anvil and power pad are all withdrawn longitudinally from the die cavity to permit ejection of the formed article. Thereafter, the ram, anvil and power are returned to the die cavity to form another billet. The total lengths of travel for the forming member are substantially greater than the distances traveled during actual formation. That is, during a substantial portion of the travel distances the members do not actually work upon the billet.

The speeds at which the forming elements travel are regulated by several factors. First, for cost reasons it is desirable to move the elements as rapidly as possible in order to minimize the time required for each forming cycle. However, the speed of travel is also regulated by the material comprising the billet and the shape of die cavity. Each material has an optimum forming velocity and various shaped die cavities require generally higher or lower velocities. These various restrictions upon velocity are not generally of concern, however, until the billet is actually being formed. Thus, it will be recognized that it is desirable to be able to move an element at a high speed prior to formation and at a lower speed during formation.

U.S. Pat. No. 4,197,757 which is incorporated herein by reference, discloses a system for providing such a high velocity and low velocity travel. Generally, in accordance with that disclosure a primary piston includes a reduced diameter section which is slidably received in a cylindrical cup member. Hydraulic fluid acts first upon only reduced diameter piston section and, after the reduced diameter section has exited from the cup member, upon the entire piston rear surface. It has been determined, however, that the high-speed-low-speed apparatus disclosed in U.S. Pat. No. 4,197,757 is somewhat limited in its applications. More specifically, this prior apparatus is not readily adaptable to varying lengths of high speed travel. In order to adjust the length of high speed travel for the formation of a different article, the machine must be torn down and portions of the system must be replaced.

Alignment in cold forming apparatus is exceedingly important because the slightest misalignment leads to repetitive tool breakage. The prior high speed system is not especially supportive of alignment of the piston because a central piston is repeatedly removed from, and reinserted into, a surrounding sleeve.

It is therefore an object of the present invention to provide a system for controlling the movement of a reciprocatory hydraulically driven element. It is also an object to provide a system in which the location of a change in the velocity of the element is easily adjustable. It is a further object to provide a system which provides additional bearing and alignment for the hydraulically driven element. Various other objects and advantages will be apparent when the following description is considered along with the accompanying drawings in which.

Figure 1:
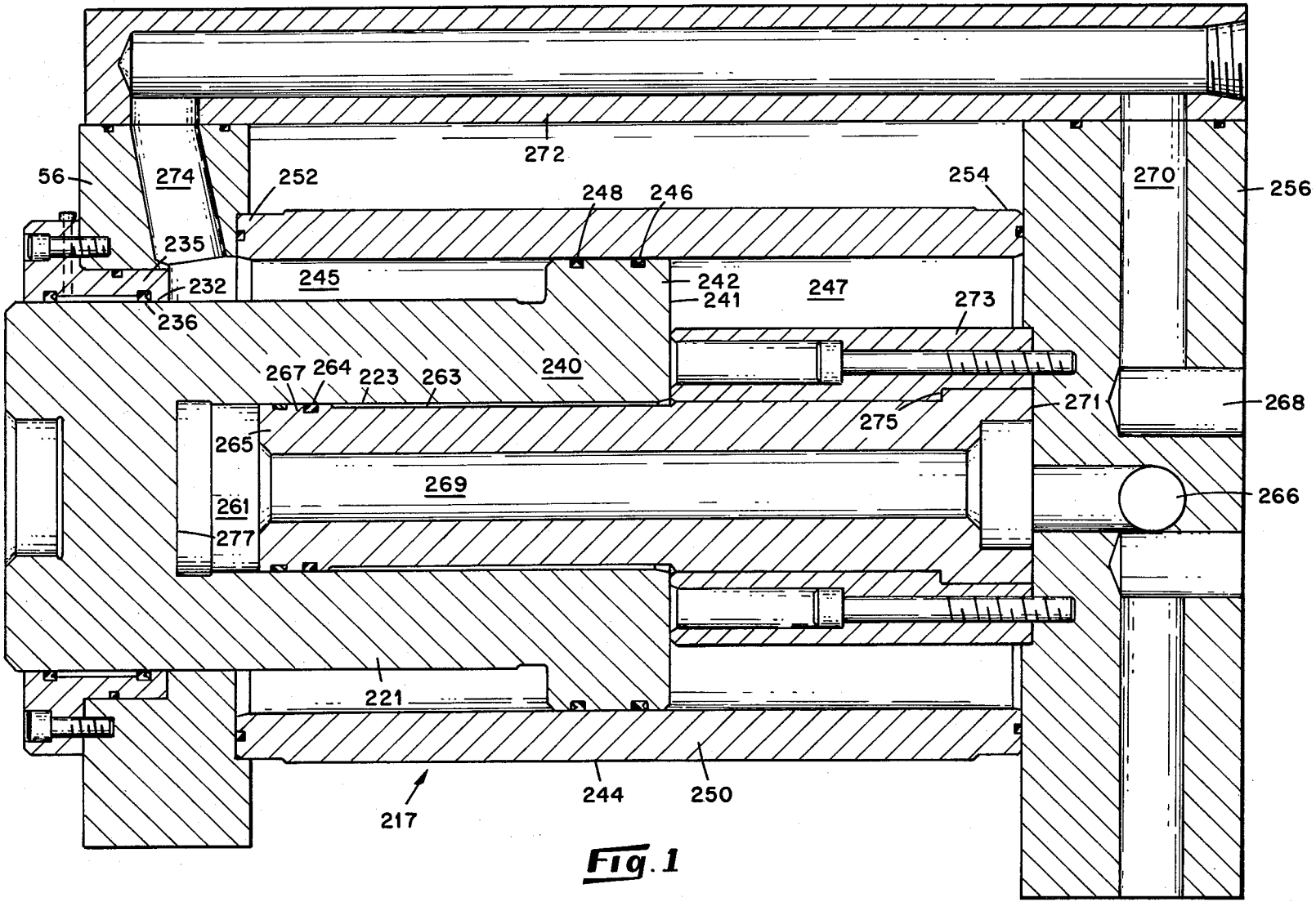
FIG. 1 is a fragmentary top view, part in section and part cutaway of one embodiment of apparatus embodying various of the features of the present invention.
Figure 2:
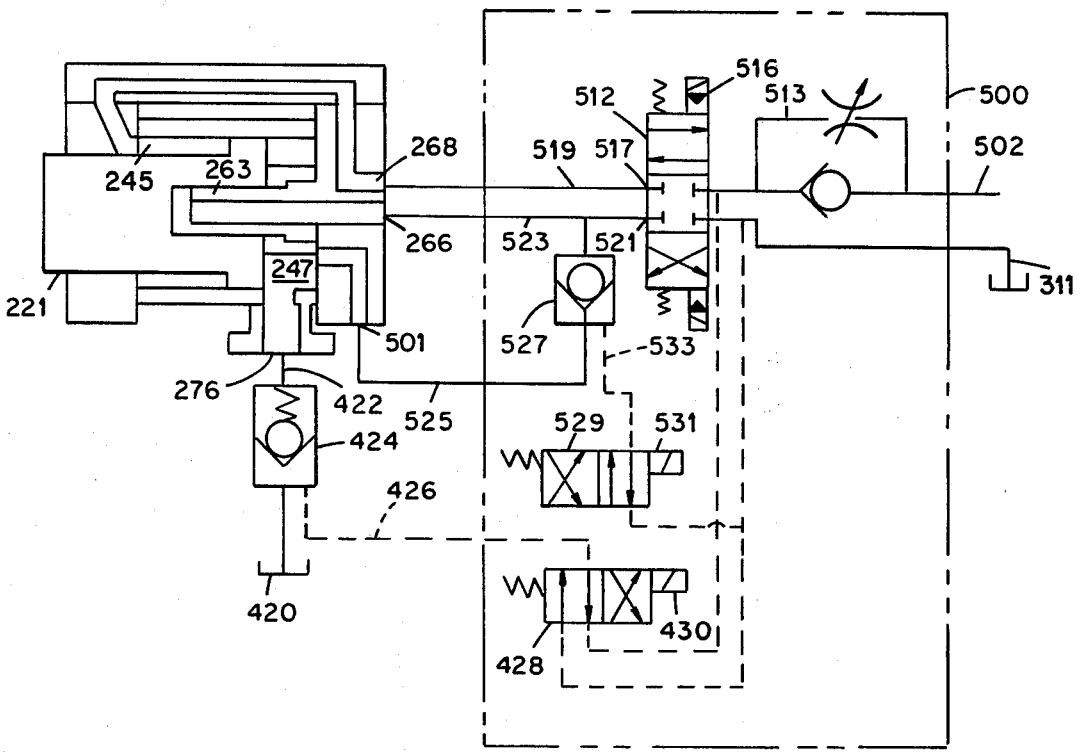
FIG. 2 is a schematic representation of a hydraulic system for controlling apparatus of the present invention.

Generally, in accordance with the present invention, a primary piston having a central longitudinal bore open at one end is slidably received within a primary piston housing to define a primary expandable reservoir. A secondary piston, having a central longitudinal bore open at both ends is secured to a fixed member and slidably received within the central bore of the primary piston to define a secondary expandable reservoir. The central bore of the secondary piston provides communication between the secondary reservoir and a source of pressurized hydraulic fluid. Communication is also provided between the primary reservoir and the source of pressurized hydraulic fluid. Electronic and hydraulic control means are provided for independently introducing pressurized hydraulic fluid into the secondary reservoir to expand the secondary reservoir and move the primary piston away from the stationary secondary piston at high velocity. When the primary piston has reached a selected location, the pressurized fluid is simultaneously introduced into the primary reservoir. The working area of the primary reservoir is substantially greater than the working area of the secondary chamber whereby, for a given flow rate for the fluid, the velocity of the element is reduced substantially, while the effective force of the element is comparably increased.

Referring more specifically to the drawings, an apparatus is depicted which is suitable for driving the anvil or ram of the apparatus of U.S. Pat. No. 4,197,757. Where appropriate, similar reference numerals will be used in order to aid in relating the presently described apparatus to the prior cold-forming apparatus.

The power for advancing or retracting an anvil, for example, is provided by means of a piston cylinder assembly 217 mounted in the plate 56.

As seen in FIG. 1, the plate 56 is provided with a central opening 232 through the central thickness thereof. This opening is further provided with a seal ring and hydrostatic rod bearing 235 that encircles a primary piston 221 which extends through the opening 232. Polypack seals 236 provide an appropriate seal for sliding action of the piston through the plate 56. The rear end 240 of the piston 221 is provided with piston head member 242 which is slidably mounted within a hollow cylinder 244 with a sliding seal therebetween being affected by seals 246 and 248. In this manner, the hollow cylinder 244 is divided into two expandable reservoirs or chambers 245 and 247, one on each of the opposite sides of the piston head 242, having a primary working face 241.

The cylinder 244 comprises a cylindrical housing 250 which has one of its ends 252 mounted in the plate 56. The housing 250 extends from the plate 56 rearwardly (to the right in FIG. 1) and is closed at its rear end 254 by a plate 256.

The piston 221 includes a central bore 223 disposed concentrically of and in axial alignment with the piston 221. The bore 223 is open at its rear end and closed by a secondary working face 277 at its forward end. The piston 221 is slidingly mounted upon a fixed secondary piston 263 which extends into the bore 223 so as to be disposed concentrically of and in axial alignment with the piston 221. The forward end 265 of the piston 263 is provided with a piston head 267 having seals 264 for sliding engagement between the head 267 and the wall of the bore 223 to define a secondary reservoir or chamber 261.

The secondary piston 263 defines a longitudinal bore 269, open at both ends, disposed concentrically of and in axial alignment with the piston 263. The piston 263 has its rear end 271 mounted in the plate 256 by a concentric stop ring 273. The ring 273 engages a shoulder 275 on the piston 263 and a plurality of bolts secure the ring 273 to the plate 256. The ring 273 also serves as a rear stop for the piston 221 through engagement with the rear end 242 of the head 240.

The plate 256 is provided with a first port 266 which is in fluid communication with the bore 269 such that hydraulic pressure applied through port 266 serves to pressurize and expand the chamber 261, urging the piston 221 to the left of FIG. 1. The plate 256 is provided with a further port 501 which is in fluid communication with the chamber 247 such that hydraulic pressure applied through port 501 serves to pressurize and expand the chamber 247, urging the piston 221 to the left of FIG. 1. The plate 256 is also provided with a port 268 which is in fluid communication through passageway 270, conduit 272, and passageway 274 to the chamber 245 of cylinder 244 on the left hand side of the piston head 242 as is seen in FIG. 1. A further port 276 of substantially enlarged opening is provided in the wall of the cylinder 244 at a location rearwardly of the most rearward position of the piston head 242 and in fluid communication with the chamber 247 of the cylinder 244.

Pressurized hydraulic fluid, for example 2000 p.s.i., is supplied to a control unit 500 through a conduit 502. The conduit 502 is connected in fluid communication with a directional control valve 512 through a volume control throttle valve 518. The directional control valve 512 provides selective directional motion to the piston 221. The valve 512 is of the double solenoid, spring centered, blocked port type and by reason of its size, adapted to permit flow of 30–150 gallons per minute, controlled by valve 518. The valve 512 is actuated by a solenoid 516. The output 517 of the valve 512 is connected through a conduit 519 to the port 268. The output 521 of the valve 512 is connected through conduit 523 to the port 266. The outlet 521 is also connected through a conduit 525 to the port 501. A pilot operated check valve 527 interposed in the conduit 525 prevents flow of fluid to the port 501 except when the check valve is overridden. The check valve is selectively supplied with pilot fluid by a directional control valve 529. The valve 529, which is activated by a solenoid 531, is supplied with hydraulic fluid from the conduit 518. Upon an appropriate signal, the valve 529 admits hydraulic fluid through conduit 533 to the check valve 527 to override the check valve and permit the flow of hydraulic fluid to the chamber 247 as well as the chamber 261.

In connection with the fast forward movement of the piston 221, it is noted that as the piston 221 is moved rapidly forwardly by the pressurized fluid in the chamber 261, there is a rapidly increasing volume change within the chamber 247. This rapid change in volume size of the chamber 247 develops a "vacuum" which would negate the desired rapid forward movement of the piston 221 in the absence of provision for accommodating such volume change. The present inventor accommodates this volume change by connecting the chamber 247 through the port 276 to a reserve hydraulic fluid reservoir or tank 420 which provides a supply of low pressure hydraulic fluid for flooding the chamber 247 without significant resistance to forward movement of the piston 221. To this end, the port 276 is relatively large. The connection between the port 276 and the tank 420 is effected as by a conduit 422 having a check valve 424 interposed therein which permits flow of hydraulic fluid toward the chamber 247 and only allows flow outwardly from the chamber 247 when the check valve is overridden. It will be further recognized that such outward flow of hydraulic fluid from the chamber 247 is desired when the piston 221 is to be moved in a rearwardly direction. Override of the check valve 424 to permit such outflow is accomplished by hydraulic pressure applied to the check valve through a conduit 426 connected through a directional control valve 428. This directional control valve 428 is activated by a solenoid 430 such that upon an appropriate signal, the directional control valve 428 admits hydraulic fluid through the conduit 426 to the check valve 424 to override the check valve and permit the flow of hydraulic fluid outwardly from the chamber 247 to the tank 420.

Figure 3:
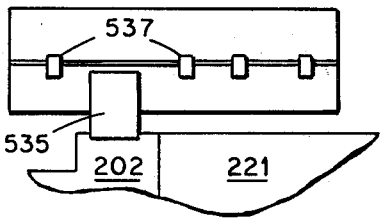
FIG. 3 is a schematic representation of an electronic flag system for use in connection with the present invention.

An electronic flag system schematically represented in FIG. 3 is provided for the piston 221 to selectively activate the solenoid valves of the control system. More specifically, the piston 221 is secured to a tool holder 202 which carries a fixed blade 535 which passes between a plurality of electronic sensors 537 to generate an electronic signal when the piston 221 reaches any of a plurality of desired locations, such as the point at which billet formation commences. The sensors 537 are adjustably mounted upon a rod 539 for longitudinal movement along the rod. Thus, by suitable placement of the sensors 537, a signal can be generated to activate the valve 529 at any location of the piston 221.

In operation, in order to move the piston 221 rapidly to the left, in FIG. 1, the valve 512 is activated by an appropriate signal to direct pressurized hydraulic fluid through the conduit 523 to the port 266. From the port 266 the fluid travels through the bore 269 to pressurize and expand the chamber 261. Simultaneously, the valve 512 permits fluid flow from the chamber 245, through the port 268, back to the reservoir 311, and the valve 424 opens to allow fluid to flood the chamber 247.

When the piston 221 reaches the forming position, at which a lower piston velocity is desired, the solenoid 531 is activated by a signal from the electronic flag system to cause the valve 529 to override the check valve 527. Pressurized hydraulic fluid is thus directed to the chamber 247 through the port 501. Forward motion continues until the piston reaches its final extrusion position. A signal generated by the electronic flag system then activates the valve 512 to switch pressurized fluid flow to the conduit 519 rather than the conduit 523. The conduit 523 is used to direct fluid from the chamber 261 to the reservoir 311. Simultaneously the valve 529 ceases to override the check valve 527 and the valve 428 is activated to override the check valve 424 to permit flow from the chamber 247 through the conduit 422 to the tank 420.

In one embodiment of an apparatus in accordance with the present invention, as described hereinabove, the working area of the chamber 261 was about 9.62 square inches, the working area of the chamber 245 was about 28.27 square inches. Employing hydraulic fluid at a pressure of about 2000 p.s.i. and flow rate of about 94 gallons per minute in such an apparatus, the piston was moved to a forming position at a velocity of about 2250 inches per minute. Then at a selected location for forming the velocity was reduced to about 441 inches per minute. Upon completion of formation the piston was returned at a velocity of about 1225 inches per minute.

At no time in the forming cycle does the secondary piston 263 disengage from the primary piston 221. Thus, the continuous engagement of the primary piston with the fixed secondary piston provides additional bearing and alignment support for the pistion 221, resulting in better formed parts and reduced tool breakage.

Employing the present system it is exceedingly simple to alter the location of velocity change by merely adjusting the location of an electronic sensor along an elongated rod.

While a preferred embodiment of the present invention has been shown and described, it will be understood that there is no intent to limit the invention by such disclosure but rather, it is intended to cover all modifications and alternate constructions falling within the spirit and scope of the invention as defined in the appended claims.

What is claimed:

1. Apparatus for controlling the movement of a reciprocatory hydraulically driven element of a metal forming machine between extended and retracted positions comprising:

primary piston means defined by said element, primary reservoir means slidably receiving said primary piston means therein and for receiving hydraulic fluid to drive said primary piston means, said primary piston means having a working face disposed in fluid communication with said primary reservoir means, secondary reservoir means defined within and centered within said primary piston, secondary piston means fixed relative to said apparatus, said secondary piston means being continuously slideably received within said secondary reservoir, a source of pressurized hydraulic fluid, first conduit means connecting said source of pressurized hydraulic fluid to said primary reservoir to selectively apply hydraulic force to the work face of said primary piston means to drive said primary piston means toward the extended position, first valve means interposed in said first conduit means for controlling the flow of hydraulic fluid between said fluid source and said primary reservoir, second conduit means connecting said source for pressurized hydraulic fluid to said secondary reservoir for applying hydraulic pressure to said secondary reservoir to drive said primary piston means toward the extended position, control means for selectively actuating said first valve means to permit flow of hydraulic fluid to said primary reservoir when said primary piston means is in a predetermined position so that said primary piston means is driven by hydraulic pressure in both said primary reservoir and said secondary reservoir, a third reservoir for holding hydraulic fluid, third conduit means connecting said third reservoir to said primary reservoir, and second valve means interposed in said third conduit means for controlling the flow of hydraulic fluid between said primary and third reservoirs and being operable to allow hydraulic fluid to flood into said primary reservoir from said third reservoir when said primary piston means is being driven solely by hydraulic pressure in said secondary reservoir and for automatically blocking hydraulic fluid flow from said primary reservoir to said third reservoir when said primary piston means is being driven by hydraulic pressure in said primary reservoir and said secondary reservoir.

2. The apparatus of claim 1 wherein said first valve means comprises an overridable check valve which selectively permits ready flow of hydraulic fluid through said first conduit means to said primary reservoir.

3. The apparatus of claim 2 wherein said second valve means selectively permits flow of hydraulic fluid through said third conduit means in a direction into said primary reservoir.

4. The apparatus of claim 1 further comprising a sensor means for sensing the location of said primary piston means, said first valve means being operatively connected to said sensor means whereby said first valve means is actuated when said primary piston reaches a predetermined location as indicated by said sensor means.

5. The apparatus of claim 1 wherein said second conduit connecting said source of pressurized fluid to said secondary reservoir includes a longitudinal bore defined by said secondary piston.

6. A method for providing two speed movement of a reciprocatory hydraulically driven primary piston relative to a secondary piston as it moves from a retracted position to an extended position in a metal working machine having primary and secondary reservoirs, comprising the steps of:

slideably disposing the primary piston on the secondary piston for sliding motion relative to the secondary piston, applying hydraulic pressure to the interior of a primary piston by introducing a high pressure hydraulic fluid into the secondary reservoir defined within a longitudinal bore formed in the primary piston with a secondary working face disposed within said bore, the secondary piston being slidably received within said bore, to longitudinally move said primary piston relative to said secondary piston from the retracted position toward the extended position, flooding the primary reservoir while the primary piston is being moved by the hydraulic fluid in the secondary reservoir by introducing low pressure hydraulic fluid into the primary reservoir, said primary piston having a primary working face disposed within said primary reservoir, diverting a portion of the high pressure hydraulic fluid being introduced into the secondary reservoir and introducing the diverted portion of high pressure hydraulic fluid into said primary reservoir when said primary piston reaches a predetermined location; and applying hydraulic pressure in an annular pattern coaxial with the primary piston on said primary working face with the diverted portion of the high pressure fluid to longitudinally move the primary piston at a slower speed than it is moved by the hydraulic pressure in the secondary reservoir, alone, before the primary piston reaches the predetermined location.

7. The method of claim 6 and further comprising the step of stopping the introduction of said low pressure hydraulic fluid when said high pressure fluid is introduced into said primary reservoir.

8. The method of claim 6 wherein said step of introducing hydraulic fluid into said secondary reservoir comprises introducing hydraulic fluid into the secondary reservoir through a longitudinal bore defined in said secondary piston and being coaxial with said primary piston.

* * * * *